US008196847B2

(12) United States Patent
Helie et al.

(10) Patent No.: US 8,196,847 B2
(45) Date of Patent: Jun. 12, 2012

(54) SPRAY HEAD FOR LIQUID PRODUCT

(75) Inventors: Arnaud Helie, La Saussaye (FR); Wilfrid Beaujour, Darnetal (FR)

(73) Assignee: Valois SAS, Le Neubourg (FR)

( * ) Notice: Subject to any disclaimer, the term of this patent is extended or adjusted under 35 U.S.C. 154(b) by 0 days.

(21) Appl. No.: 10/566,708

(22) PCT Filed: Jul. 27, 2004

(86) PCT No.: PCT/FR2004/002006

§ 371 (c)(1),
(2), (4) Date: Mar. 1, 2006

(87) PCT Pub. No.: WO2005/018812

PCT Pub. Date: Mar. 3, 2005

(65) Prior Publication Data

US 2006/0249598 A1 Nov. 9, 2006

(30) Foreign Application Priority Data

Aug. 8, 2003 (FR) ..... 03 09797

(51) Int. Cl.
*B05B 1/34* (2006.01)

(52) U.S. Cl. ..... 239/484; 239/392; 239/493; 239/491

(58) Field of Classification Search ..... 239/469, 239/490, 396, 392, 493, 491
See application file for complete search history.

(56) References Cited

U.S. PATENT DOCUMENTS

| | | | | | |
|---|---|---|---|---|---|
| 3,112,074 | A | * | 11/1963 | Green | 239/493 |
| 3,129,893 | A | * | 4/1964 | Green | 239/490 |
| 3,284,007 | A | * | 11/1966 | Clapp | 239/392 |
| 3,363,808 | A | * | 1/1968 | Gorman | 222/633 |
| 3,471,092 | A | * | 10/1969 | Hickey | 239/579 |
| 3,625,437 | A | * | 12/1971 | Garrigou | 239/469 |
| 3,724,763 | A | * | 4/1973 | Braun | 239/490 |
| 4,036,439 | A | * | 7/1977 | Green | 239/466 |
| 4,161,281 | A | * | 7/1979 | Erb et al. | 239/8 |
| 4,187,985 | A | * | 2/1980 | Goth | 239/337 |
| 4,801,093 | A | * | 1/1989 | Brunet et al. | 239/490 |
| 4,923,448 | A | * | 5/1990 | Ennis, III | 604/239 |
| 5,064,122 | A | * | 11/1991 | Kamishita et al. | 239/396 |
| 5,203,840 | A | * | 4/1993 | Graf et al. | 222/321.6 |
| 5,224,471 | A | * | 7/1993 | Marelli et al. | 128/200.14 |
| 5,711,488 | A | * | 1/1998 | Lund | 239/333 |
| 5,738,282 | A | * | 4/1998 | Grogan | 239/492 |
| 5,992,765 | A | * | 11/1999 | Smith | 239/493 |
| 6,189,739 | B1 | * | 2/2001 | von Schuckmann | 222/182 |
| 6,371,389 | B1 | * | 4/2002 | Bickart et al. | 239/491 |

FOREIGN PATENT DOCUMENTS

| | | |
|---|---|---|
| EP | 0 412 524 A1 | 2/1991 |
| EP | 0 499 690 A1 | 8/1992 |
| FR | 1 355 350 A | 3/1964 |
| FR | 2 821 573 A | 9/2002 |

* cited by examiner

*Primary Examiner* — Len Tran
*Assistant Examiner* — Trevor E McGraw
(74) *Attorney, Agent, or Firm* — Sughrue Mion, PLLC

(57) ABSTRACT

A fluid spray head comprising an expulsion channel (5) provided with a spray orifice (1) and a spray profile (10) formed in an end wall of said spray head, said spray profile (10) comprising preferably non-radial spray channels (11) opening out to a central spray chamber (12) disposed directly upstream from said spray orifice (1), an insert (20) being disposed in said expulsion channel (5) so as to form a cover for said spray profile (10), the central axis (X) of said insert (20) being substantially identical to the central axis (Y) of said expulsion channel (5), and said spray head including centering means for centering said insert (20).

20 Claims, 4 Drawing Sheets

SPRAY HEAD FOR LIQUID PRODUCT

The present invention relates to a fluid spray head.

Fluid dispenser heads are well known, in particular in the field of pharmacy. In order to dispense a fine spray, the head generally includes a spray profile disposed just upstream from the spray orifice. The spray profile can be formed by an external part, known as an external nozzle, fastened on the outside, as described in documents U.S. Pat. No. 3,625,437, EP-0 906 785, FR-1 355 350, and EP-0 412 524. That solution presents the major drawback of a risk of said nozzle being expelled during use. In order to mitigate that drawback, it is proposed to make the spray profile by means of an insert that is inserted into the head through the inside of said head, said insert forming the end wall of said spray profile and limiting the dead volume. The characteristics of the spray, in particular the size distribution of the droplets and the reproducibility of such characteristics, are largely dependent on the shape of said spray profile. It turns out that in most fluid dispenser devices, in particular of medicines, the performance is not very consistent because of manufacturing tolerances during molding of the head. In particular, this results in the central axis of the orifice of the insert being offset from the central axis of the spray chamber. Such offset, shown in FIG. 2, can result in the spray profile being asymmetrical, with access to one of the non-radial channels being practically blocked. As a result, the fluid does not swirl as much in the spray chamber, and the performance and characteristics of the spray are thus affected. Such offset of the axes can be substantial, and can in particular vary greatly from one head to another. This prevents consistent spray characteristics from being obtained. FIG. 4 also shows a vertical section view of a fluid spray head with an internal nozzle according to the prior art.

An object of the present invention is to provide a fluid spray head that does not have the above-mentioned drawbacks.

More particularly, an object of the present invention is to provide a fluid spray head that is safe and reliable and that has fluid spray characteristics and performance that are consistent and reproducible for any head coming from a common mold cavity.

Another object of the present invention is to provide a fluid spray head that is simple and inexpensive to manufacture and to assemble.

The present invention thus provides a fluid spray head comprising an expulsion channel provided with a spray orifice and a spray profile formed in an end wall of said spray head, said spray profile comprising preferably non-radial spray channels opening out to a central spray chamber disposed directly upstream from said spray orifice, an insert being disposed in said expulsion channel so as to form the base surface for said spray profile, the central axis of said insert being substantially identical to the central axis of said expulsion channel, and said spray head including centering means for centering said insert.

Advantageously, said expulsion channel includes said centering means for centering said insert.

Advantageously, said centering means comprise at least one projection, and preferably three, the diameter of the inscribed circle defined by said projections being substantially identical to the diameter of the insert.

Advantageously, the expulsion channel includes three flat surfaces that are distributed symmetrically about said channel, said flat surfaces co-operating with said insert so as to center it relative to said expulsion channel.

Advantageously, the accesses of the expulsion channel to the spray channels are formed between said projections.

Advantageously, the central axis of said insert is offset from the central axis of the expulsion channel by a distance that is less than 0.08 mm, and preferably less than 0.03 mm.

Advantageously, said spray chamber has a diameter of 1 mm.

Advantageously, said spray orifice has a diameter of 0.3 mm.

The present invention also provides a set of spray heads manufactured from a common mold cavity, said heads being made as described above. A set of spray head assemblies A is shown in FIG. 5, the set comprising a first spray head B and a second spray head C.

Advantageously, the standard deviation of the offset of the central axis of the insert relative to the central axis of the expulsion channel for any spray head coming from a common mold cavity is less than 0.05 mm, and advantageously less than 0.02 mm.

The present invention also provides a fluid dispenser device including a head as described above.

Other characteristics and advantages of the present invention appear more clearly from the following detailed description of an advantageous embodiment thereof, given by way of non-limiting example, and with reference to the accompanying drawings, and in which.

The present invention applies to any type of fluid spray head. However, the present description is made with reference to an elongate head, e.g. a nasal dispenser head, including a spray orifice directed along the axis of the head. Naturally, the present invention could apply to any type of head, and in particular heads in which the spray is dispensed transversally.

Figure 1:
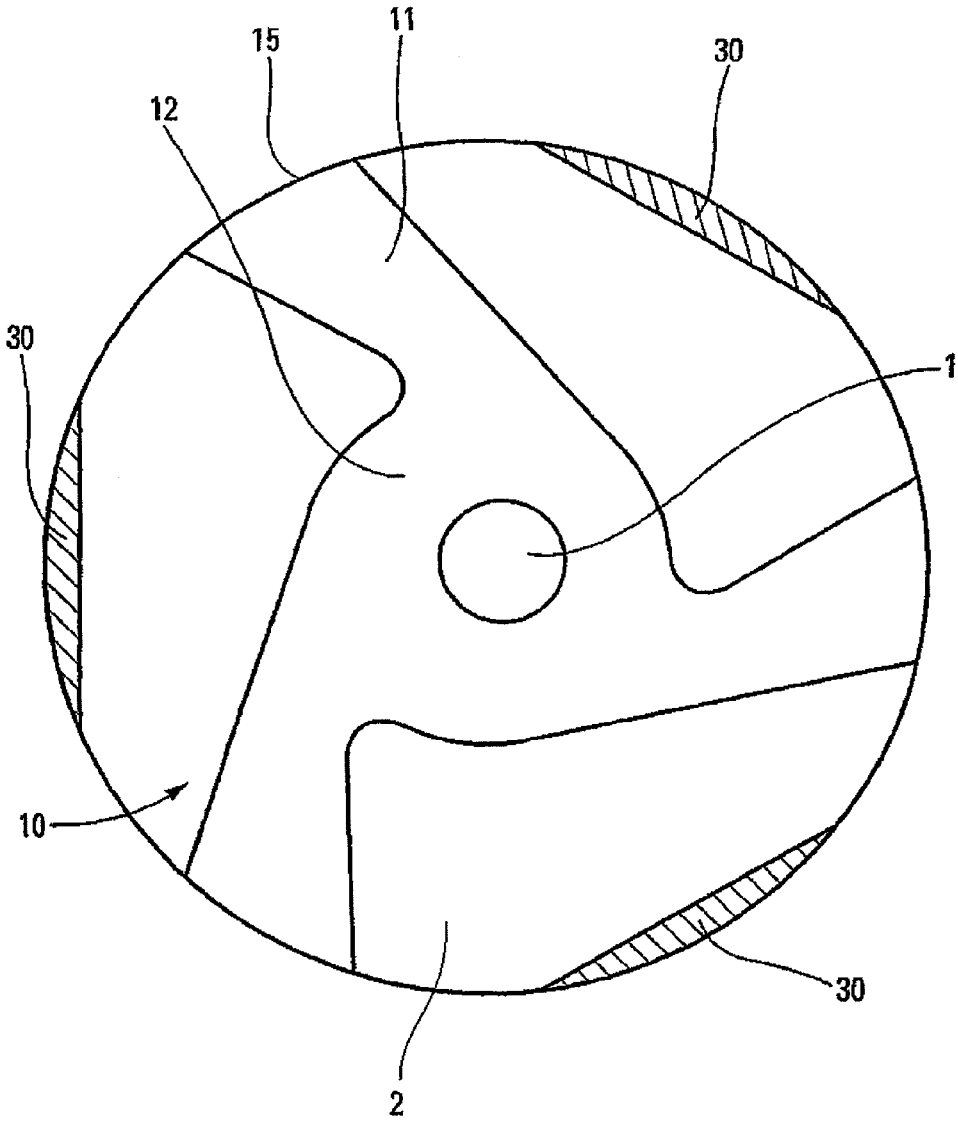
FIG. 1 is a diagrammatic view in horizontal section through the spray profile of a dispenser head of the present invention.

In the invention, the fluid spray head includes an expulsion channel 5 that is provided with a spray orifice 1 and with a spray profile 10 that is disposed upstream from said spray orifice 1. The spray profile 10 is formed in the end wall 2 of the spray head, and, in known manner, comprises preferably non-radial spray channels 11 leading into a central spray chamber 12 disposed directly upstream from said spray orifice 1. The channels can be three in number, as shown in FIG. 1, but some other configuration can be envisaged. An insert 20, that is preferably solid and of simple shape similar to a rod, is provided in said expulsion channel 5 so as to limit the dead volume and form a cover for said spray profile 10. The insert 20 is inserted through the inside of the head and thus forms an internal nozzle which, in contrast to an external nozzle fastened on the outside of the head, does not risk being expelled during actuation. Thus, the fluid flowing along the expulsion channel 5 and around said insert via the access 15 reaches the non-radial channels 11 in front of the front face of said insert. The fluid then swirls into the spray chamber 12 before being expelled through the spray orifice 1 in the form of spray. The device of the invention is thus formed of only two parts, an external part forming the head, and an internal part forming the insert.

The present invention is characterized by the fact that, as far as possible, the central axis X of the insert 20 is identical to the central axis Y of the expulsion channel 5.

Figure 2:
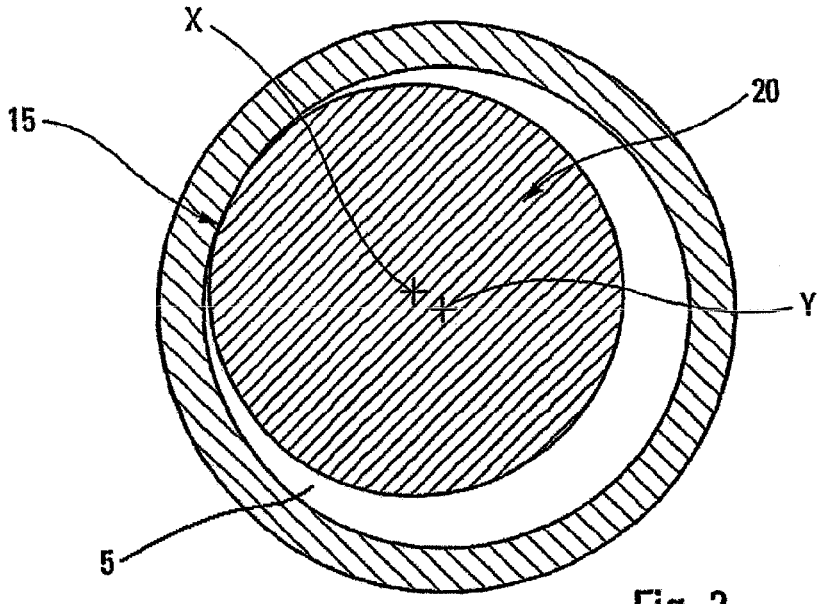
FIG. 2 is a diagrammatic view in horizontal section through the expulsion channel of a prior-art spray head.
Figure 3:
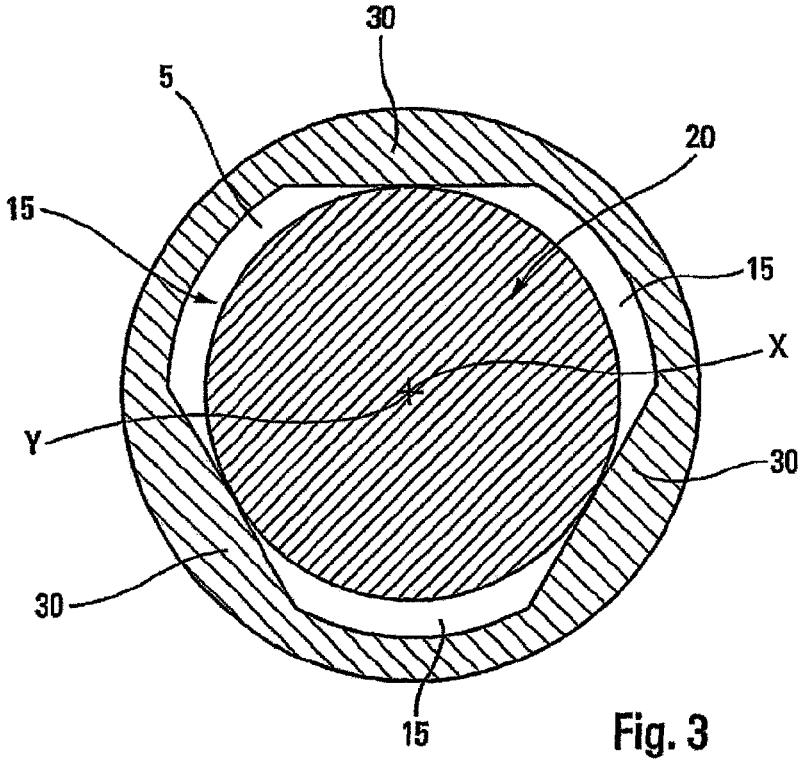
FIG. 3 is a diagrammatic view in horizontal section through the expulsion channel of a spray head constituting an embodiment of the present invention.
Figure 4:
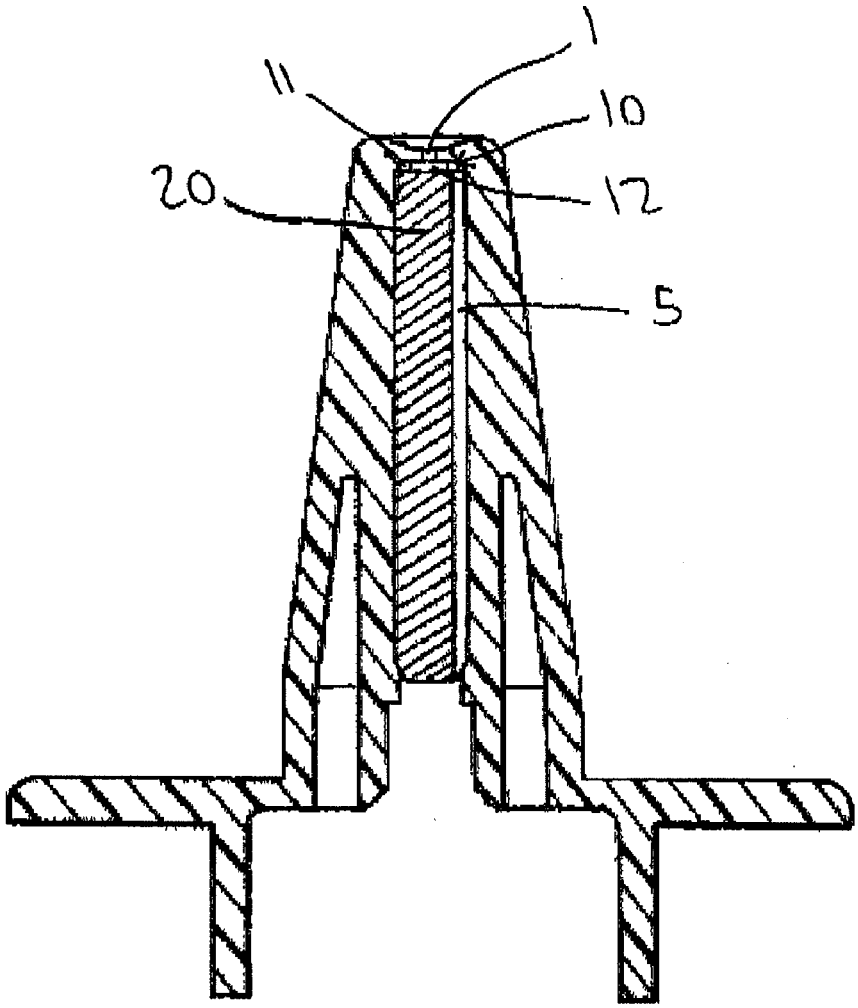
Fig. 4 (Prior Art)
FIG. 4 is a diagrammatic view in vertical section through the expulsion channel of a prior-art spray head.
Figure 5:
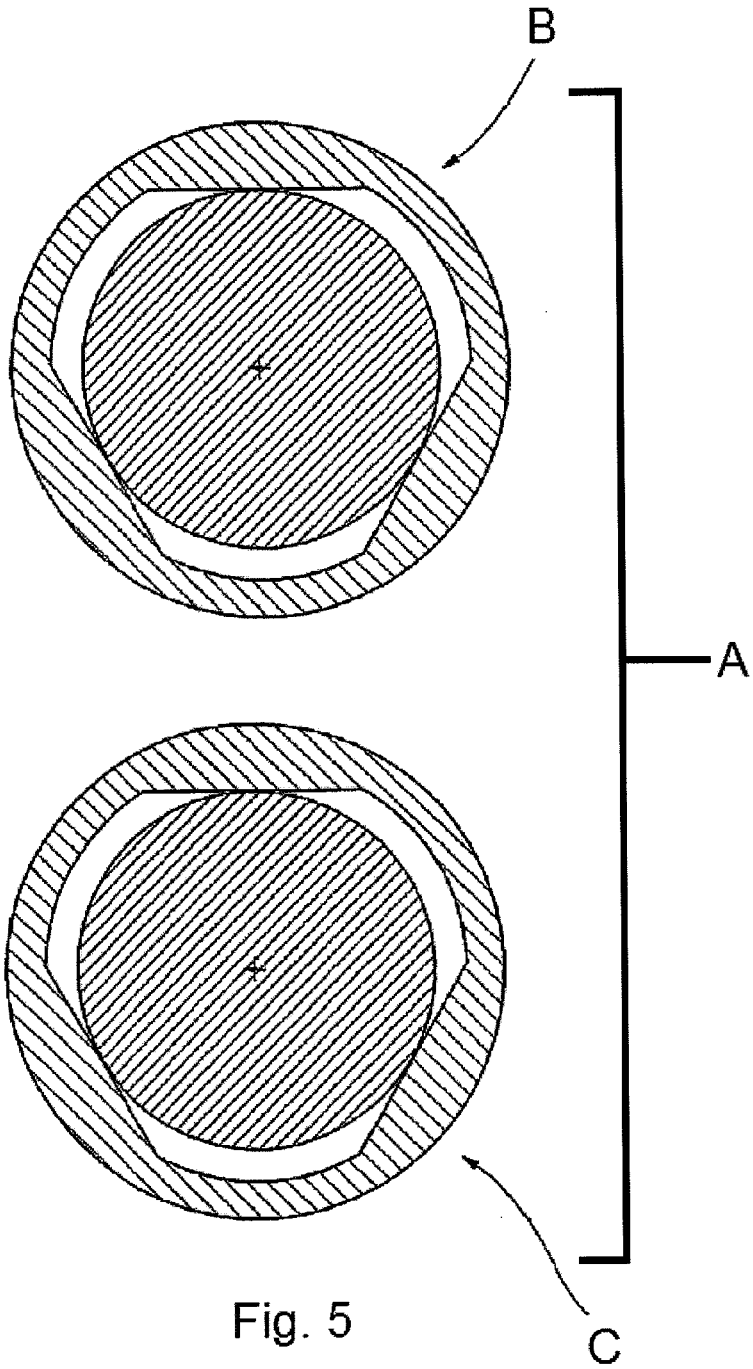
FIG. 5 is a diagrammatic view in horizontal section through the expulsion channels of a set of spray heads.

To do this, centering means are provided for the insert 20. The centering means are preferably formed in the expulsion channel 5, in the proximity of said spray profile 10. They can comprise one or more projections adapted to co-operate with the insert 20 so as to center it. FIG. 3 shows an advantageous embodiment in which the expulsion channel 5 includes three flat surfaces 30 that are evenly distributed around the channel. The projections define an inscribed circle having a diameter that corresponds approximately to the diameter of the insert 20. In this way, by placing the flat surfaces 30 between the accesses 15 to the non-radial channels 11 of the spray profile 10, while the insert 20 is being assembled, the insert 20 is prevented from closing off one of the accesses 15, as shown in FIG. 2 for the prior-art head. The flat surfaces could be replaced by different profiles, such as convex or concave projections, e.g. circular arcs, or even by a plurality of lugs distributed around the channel. Since the insert 20 is centered, the fluid flows in approximately equal manner through the three channels 11, and a good spray is formed with optimum spray characteristics both in terms of performance (average size of droplets and droplet size distribution) and in terms of consistency (reproducibility of performance for any head). Naturally, the manufacturing tolerances of the expulsion channel 5 and of the insert 20 can cause the axes X and Y to be a little offset, but the flat surfaces 30 make it possible to limit such offset. Such offset is advantageously less than 0.08 mm, and preferably less than 0.03 mm. In addition, by means of the present invention, spray heads coming from a common mold cavity present a standard deviation for the offset of the central axis X of the insert relative to the central axis Y of the expulsion channel, that is less than 0.05 mm, and preferably less than 0.02 mm. The relatively small offset values, together with the standard deviation that is much smaller than the standard deviation that currently exists, make it possible to improve the quality of the spray.

A particularly advantageous embodiment relates to a dispenser head in which the spray chamber 12 has a diameter of about 1 mm, and the spray orifice 1 has a diameter of about 0.3 mm.

The present invention thus makes it possible to improve fluid dispenser heads by improving the characteristics and the performance of the spray that it dispenses, and also improving the consistency of those characteristics.

Although the present invention is described above with reference to a particular embodiment thereof, it is clear that it is not limited by said embodiment. On the contrary, any useful modifications can be applied thereto by the person skilled in the art, without going beyond the ambit of the present invention, as defined by the accompanying claims.

The invention claimed is:

1. A fluid spray head assembly comprising:

a spray head comprising an expulsion channel (5) provided with a spray orifice (1) and a spray profile (10) formed in an end wall of said spray head, said spray profile (10) comprising non-radial spray channels (11) opening out to a central spray chamber (12) disposed directly upstream from said spray orifice (1);

an insert (20) forming an internal nozzle, the insert being introduced through the inside of the spray head and being disposed in said expulsion channel (5) so as to form a base surface for said spray profile (10), the central axis (X) of said insert (20) being substantially identical to the central axis (Y) of said expulsion channel (5); and said spray head comprising centering means for centering said insert (20), said expulsion channel (5) including said centering means for centering said insert (20), said centering means formed on a surface of the spray head that forms the expulsion channel at a location directly adjacent to a top end of the insert, the top end of the insert facing the spray profile (10) formed in the end wall of the spray head;

wherein the central spray chamber is between the spray orifice of the spray head and the insert; and wherein the insert is formed separately from the spray head.

2. A spray head assembly according to claim 1, in which said centering means comprise at least one projection (30), the diameter of the inscribed circle defined by said projections being substantially identical to the diameter of the insert (20).

3. A spray head assembly according to claim 2, in which the expulsion channel (5) includes three flat surfaces (30) that are distributed symmetrically about said channel, said flat surfaces (30) co-operating with said insert (20) so as to center it relative to said expulsion channel (5).

4. A spray head assembly according to claim 2, in which the accesses of the expulsion channel (5) to the spray channels (11) are formed between said projections.

5. A spray head assembly according to claim 1, in which the central axis (X) of said insert (20) is offset from the central axis (Y) of the expulsion channel (5) by a distance that is less than 0.08 mm, and preferably less than 0.03 mm.

6. A spray head assembly according to claim 1, in which said spray chamber (12) has a diameter of 1 mm.

7. A spray head assembly according to claim 1, in which said spray orifice (1) has a diameter of 0.3 mm.

8. A set of spray head assemblies according to claim 1, wherein the spray head of each spray head assembly is manufactured from a common mold cavity.

9. A set of spray head assemblies according to claim 8, in which the standard deviation of the offset of the central axis (X) of the insert (20) relative to the central axis (Y) of the expulsion channel (5) for any spray head coming from a common mold cavity is less than 0.05 mm, and advantageously less than 0.02 mm.

10. A fluid dispenser device characterized in that it includes a spray head assembly according to claim 1.

11. A fluid spray head assembly, comprising:

a spray head comprising an expulsion channel, a spray orifice and a spray profile formed in an end wall of the spray head, the spray profile comprising spray channels opening out to a central spray chamber disposed upstream from the spray orifice;

an insert disposed in the expulsion channel so as to form a base surface for the spray profile, the insert forming an internal nozzle, the spray head configured with an upstream opening to permit the insert to be introduced inside the spray head only from the upstream opening in the spray head, and wherein, a central axis of the insert is substantially identical to a central axis of the expulsion channel; and at least one radial projection extending from an inside wall of the expulsion channel and abutting the insert so as to substantially align the central axis of the insert with the central axis of the expulsion channel;

wherein the at least one radial projection extends from the inside wall at a location directly adjacent to a top end of the insert, wherein the top end of the insert faces the spray profile formed in the end wall of the spray head;

wherein the central spray chamber is between the spray orifice of the spray head and the insert;

wherein the insert is formed separately from the spray head.

12. The fluid spray head assembly according to claim 11, wherein the spray channels are non-radial.

13. The fluid spray head assembly according to claim 11, further comprising at least two additional projections extending from the inside wall of the expulsion channel and abutting the insert so as to substantially align the central axis of the insert with the central axis of the expulsion channel.

14. The fluid spray head assembly according to claim 11, further comprising at least two additional projections extending from the inside wall of the expulsion channel, and wherein a diameter of an inscribed circle defined by the three projections is substantially identical to a diameter of the insert.

15. The fluid spray head assembly according to claim 14, wherein the three projections define three flat surfaces distributed symmetrically about the central axis of the expulsion channel.

16. The fluid spray head assembly according to claim 14, wherein access from the expulsion channel to the spray channels is between the projections.

17. The fluid spray head assembly according to claim 1, wherein the spray head is configured to couple to a dispensing member.

18. The fluid spray head assembly according to claim 11, wherein the fluid spray head is configured to couple to a dispensing member.

19. A spray head assembly according to claim 1, in which said centering means comprise three projections (30), the diameter of the inscribed circle defined by said projections being substantially identical to the diameter of the insert (20).

20. A spray head assembly according to claim 1, wherein the centering means contacts the insert at the location directly adjacent to the top end of the insert.

* * * * *